US009250574B2

(12) United States Patent
Nakaegawa et al.

(10) Patent No.: US 9,250,574 B2
(45) Date of Patent: Feb. 2, 2016

(54) IMAGE FORMING APPARATUS WITH INTERMEDIATE TRANSFER MEMBER HAVING CONSTANT VOLTAGE ELEMENT

(71) Applicant: CANON KABUSHIKI KAISHA, Tokyo (JP)

(72) Inventors: Tohru Nakaegawa, Nagareyama (JP); Masanori Shida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/506,033

(22) Filed: Oct. 3, 2014

(65) Prior Publication Data

US 2015/0023680 A1 Jan. 22, 2015

Related U.S. Application Data

(63) Continuation of application No. PCT/JP2013/060763, filed on Apr. 3, 2013.

(30) Foreign Application Priority Data

Apr. 3, 2012 (JP) ..... 2012-084974

(51) Int. Cl.
*G03G 15/16* (2006.01)
*G03G 15/00* (2006.01)

(52) U.S. Cl.
CPC ..... *G03G 15/1605* (2013.01); *G03G 15/1675* (2013.01); *G03G 15/50* (2013.01); *G03G 15/5004* (2013.01)

(58) Field of Classification Search
CPC ..... G03G 15/1605; G03G 15/50
See application file for complete search history.

(56) References Cited

U.S. PATENT DOCUMENTS 6,294,305 B1 9/2001 Kobayashi et al.
6,421,521 B2 7/2002 Tanaka
(Continued)

FOREIGN PATENT DOCUMENTS

JP 2001-175092 A 6/2001
JP 2001-255761 A 9/2001
(Continued)

OTHER PUBLICATIONS

International Search Report (PCT/ISA/210) dated Jun. 25, 2013, issued in PCT Application No. PCT/JP2013/060763, Notification of Transmittal of the International Search Report and the Written Opinion of the International Searching Authority, or the Declaration (PCT/ISA/220), and Written Opinion of the International Searching Authority (PCT/ISA/237).

*Primary Examiner* — Sandra Brase
(74) *Attorney, Agent, or Firm* — Fitzpatrick, Cella, Harper & Scinto

(57) ABSTRACT

In a constitution in which a power source exclusively for primary transfer is omitted and a predetermined voltage is generated in an intermediary transfer member by a constant-voltage element, a high power source voltage more than necessary is applied in order to avoid primary transfer defect, so that a transfer member is deteriorated by energization in some cases. By detecting a current flowing into the constant-voltage element, it becomes possible to obtain a minimum power source voltage at which the intermediary transfer member is capable of maintaining a predetermined voltage, so that it is possible to avoid the energization deterioration of the transfer member.

13 Claims, 4 Drawing Sheets

(56) References Cited

U.S. PATENT DOCUMENTS

| | | | | |
|---|---|---|---|---|
| 6,829,450 | B2 | 12/2004 | Tamiya et al. | |
| 6,901,234 | B2 * | 5/2005 | Ogiyama et al. | 399/302 |
| 7,620,354 | B2 | 11/2009 | Shimura et al. | |
| 8,265,499 | B2 | 9/2012 | Sueoka | |
| 8,532,514 | B2 | 9/2013 | Shida | |
| 8,634,737 | B2 | 1/2014 | Nakaegawa | |
| 2004/0165902 | A1 * | 8/2004 | Matsuura | 399/66 |
| 2009/0080923 | A1 | 3/2009 | Murayama | |
| 2010/0209128 | A1 * | 8/2010 | Sueoka | 399/66 |
| 2013/0188980 | A1 | 7/2013 | Ito et al. | |

FOREIGN PATENT DOCUMENTS

| | | | |
|---|---|---|---|
| JP | 2001-265135 | | 9/2001 |
| JP | 2003-35986 | A | 2/2003 |
| JP | 2003-57917 | A | 2/2003 |
| JP | 2003-280331 | A | 10/2003 |
| JP | 2004-117920 | | 4/2004 |
| JP | 2005-250254 | A | 9/2005 |
| JP | 2006-259640 | A | 9/2006 |
| JP | 2010-191276 | | 9/2010 |
| JP | 2011-39428 | A | 2/2011 |
| JP | 2012-98709 | A | 5/2012 |

* cited by examiner

IMAGE FORMING APPARATUS WITH INTERMEDIATE TRANSFER MEMBER HAVING CONSTANT VOLTAGE ELEMENT

This application is a continuation of PCT Application No. PCT/JP2013/060763, filed on Apr. 3, 2013.

TECHNICAL FIELD

The present invention relates to an image forming apparatus using an electrophotographic type, such as a copying machine, a printer or the like.

BACKGROUND ART

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-open Patent Application 2003-35986 discloses a conventional constitution of the intermediary transfer type. More particularly, in Japanese Laid-open Patent Application 2003-35986, in order to primary-transfer the toner image from the photosensitive member onto the intermediary transfer member, a primary-transfer roller is provided, and a power source exclusively for the primary-transfer is connected to the primary-transfer roller. Furthermore, in Japanese Laid-open Patent Application 2003-35986, in order to secondary-transfer the toner image from the intermediary transfer member onto the recording material, a secondary-transfer roller is provided, and a voltage source exclusively for the secondary-transfer is connected to the secondary-transfer roller.

In Japanese Laid-open Patent Application 2006-259640, there is a constitution in which a voltage source is connected to an inner secondary-transfer roller, and another voltage source is connected to the outer secondary-transfer roller. In Japanese Laid-open Patent Application 2006-259640, there is description to the effect that the primary-transfer of the toner image from the photosensitive member onto the intermediary transfer member is effected by voltage application to the inner secondary-transfer roller by the voltage source.

SUMMARY OF THE INVENTION

Problem to be Solved by Invention

However, when the voltage source exclusively for the primary-transfer is provided, there is a liability that it leads to an increase in cost, so that a method for omission of the voltage source exclusively for the primary-transfer is desired.

A constitution in which a voltage source exclusively for the primary-transfer is omitted, and the intermediary transfer member is grounded through a constant-voltage element to produce a predetermined primary-transfer voltage, has been found.

However, in the above constitution, unless the constant-voltage element can maintain a predetermined voltage, the primary-transfer voltage is lower than a predetermined voltage to generate a primary-transfer defect. Therefore, in order to avoid the primary-transfer defect, when the voltage is set at a high power source voltage more than necessary, there is a problem that a transfer member is deteriorated by energization.

Means for Solving Problem

The present invention provides an image forming apparatus includes: an image bearing member for bearing a toner image; an intermediary transfer member for carrying the toner image transferred from the image bearing member at a primary-transfer position; a transfer member, provided contactable with an outer peripheral surface of the intermediary transfer member, for transferring the toner image from the intermediary transfer member onto a recording material at a secondary-transfer position; a constant-voltage element, electrically connected between the intermediary transfer member and a ground potential, for maintaining a predetermined voltage by passing of a current therethrough; a power source for forming, by applying a voltage to the transfer member to pass the current through the constant-voltage element, both of a secondary-transfer electric field at the secondary-transfer position and a primary-transfer electric field at the primary-transfer position; a current detecting portion for detecting the current passing through the constant-voltage element; and a controller for controlling, on the basis of a result detected by the current detecting portion by applying a test voltage to the transfer member by the power source, a voltage to be applied to the transfer member by the power source so that the constant-voltage element maintains the predetermined voltage in a predetermined period.

Effect of the Invention

In the constitution in which the predetermined voltage is generated in the intermediary transfer member by the constant-voltage source, it is possible to avoid the transfer defect capable of generating in the case where the timing of the primary-transfer and the timing of application of the voltage to the transfer member are overlapped.

Effect of the Invention

In the constitution in which the predetermined voltage is generated in the intermediary transfer member by the constant-voltage source, it becomes possible to set the voltage at the necessary minimum power source voltage, so that it is possible to avoid the energization deterioration of the transfer member.

EMBODIMENTS FOR CARRYING OUT INVENTION

Figure 1:
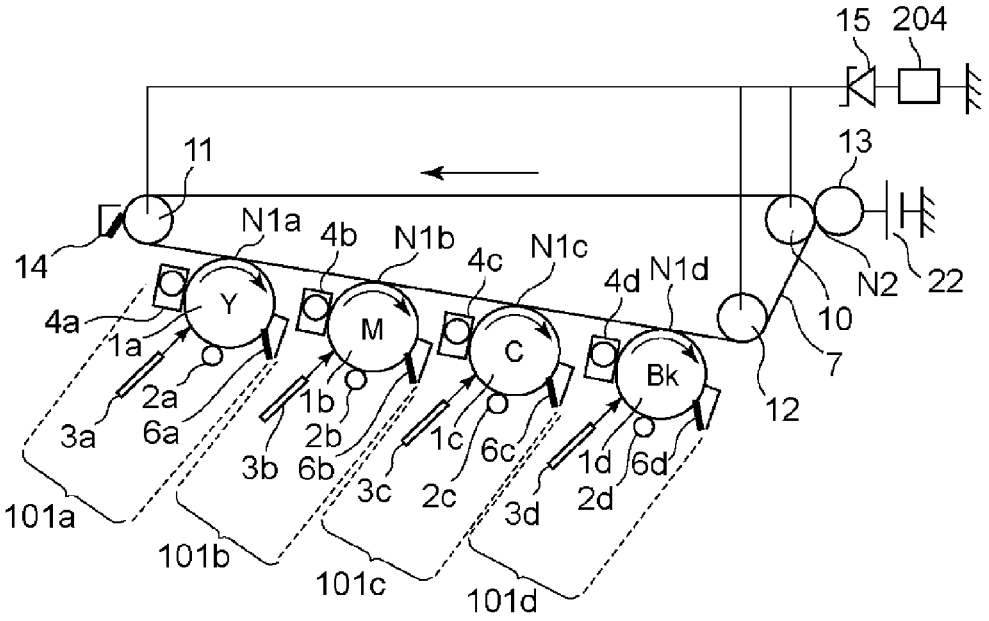
FIG. 1 is an illustration of a basic structure of an image forming apparatus.

In the following, embodiments of the present invention will be described along the drawings. Incidentally, in each of the drawings, the same reference numerals are assigned to elements having the same structures or functions, and the redundant description of these elements is omitted.

Embodiment 1

Image Forming Apparatus

FIG. 1 shows an image forming apparatus in this embodiment. The image forming apparatus employs a tandem type in which image forming units for respective colors are independent and arranged in tandem. In addition, the image forming apparatus employs an intermediary transfer type in which toner images are transferred from the image forming units for respective colors onto an intermediary transfer member, and then are transferred from the intermediary transfer member onto a recording material.

Image forming stations 101*a*, 101*b*, 101*c*, 101*d* are image forming means for forming yellow (Y), magenta (M), cyan (C) and black (K) toner images, respectively. These image forming units are disposed in the order of the image forming units 101*a*, 101*b*, 101*c* and 101*d*, that is, in the order of yellow, magenta, cyan and black, from an upstream side with respect to a movement direction of an intermediary transfer belt 7.

The image forming units 101*a*, 101*b*, 101*c*, 101*d* include photosensitive drums 1*a*, 1*b*, 1*c*, 1*d* as photosensitive members (image bearing members), respectively, on which the toner images are formed. Primary chargers 2*a*, 2*b*, 2*c*, 2*d* are charging means for charging surfaces of the respective photosensitive drums 1*a*, 1*b*, 1*c*, 1*d*. Exposure devices 3*a*, 3*b*, 3*c*, 3*sd* are provided with laser scanners to expose to light the photosensitive drums 1*a*, 1*b*, 1*c* and 1*d* charged by the primary chargers. By outputs of the laser scanners being rendered on and off on the basis of image information, electrostatic images corresponding to images are formed on the respective photosensitive drums. That is, the primary charger and the exposure means function as electrostatic image forming means for forming the electrostatic image on the photosensitive drum. Developing devices 4*a*, 4*b*, 4*c* and 4*d* are provided with accommodating containers for accommodating the yellow, magenta, cyan and black toner and are developing means for developing the electrostatic images on the photosensitive drum 1*a*, 1*b*, 1*c* and 1*d* using the toner.

The toner images formed on the photosensitive drums 1*a*, 1*b*, 1*c*, 1*d* are primary-transferred onto an intermediary transfer belt 7 in primary-transfer portions N1*a*, N1*b*, N1*c* and N1*d* (primary-transfer positions). In this manner, four color toner images are transferred superimposedly onto the intermediary transfer belt 7. The primary-transfer will be described in detail hereinafter.

Photosensitive member drum cleaning devices 6*a*, 6*b*, 6*c* and 6*d* remove residual toner remaining on the photosensitive drums 1*a*, 1*b*, 1*c* and 1*d* without transferring in the primary-transfer portions N1*a*, N1*b*, N1*c* and N1*d*.

The intermediary transfer belt 7 (intermediary transfer member) is a movable intermediary transfer member onto which the toner images are to be transferred from the photosensitive drums 1*a*, 1*b*, 1*c*, 1*d*. In this embodiment, the intermediary transfer belt 7 has a two layer structure including a base layer and a surface layer. The base layer is at an inner side (inner peripheral surface side, stretching member side) and contacts the stretching member. The surface layer is at an outer surface side (outer peripheral surface side, image bearing member side) and contacts the photosensitive drum. The base layer comprises a resin material such as polyimide, polyamide, PEN, PEEK, or various rubbers, with a proper amount of an antistatic agent such as carbon black incorporated. The base layer of the intermediary transfer belt 7 is formed to have a volume resistivity of $10^2$-$10^7$ Ωcm thereof. In this embodiment, the base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm in a thickness direction is applied. That is, the volume resistivity of the base layer is lower than that of the surface layer.

In the case where the intermediary transfer member has two or more layer structure, the volume resistivity of the outer peripheral surface side layer is higher than that of the inner peripheral surface side layer.

The thickness of the surface layer is 0.5-10 μm. Of course, the thickness is not intended to be limited to these numerical values.

The intermediary transfer belt 7 is stretched while contacting the intermediary transfer belt 7 by stretching rollers 10, 11 and 12 contacting the inner peripheral surface of the intermediary transfer belt 7. The roller 10 is driven by a motor as a driving source, thus functioning as a driving roller for driving the intermediary transfer belt 7. Further, the roller 10 is also an inner secondary-transfer roller urged toward the outer secondary-transfer roller 13 with the intermediary transfer belt. The roller 11 functions as a tension roller for applying a predetermined tension to the intermediary transfer belt 7. In addition, the roller 11 functions also as a correction roller for preventing snaking motion of the intermediary transfer belt 7. A belt tension to the tension roller 11 is constituted so as to be approx. 5-12 kgf. By this belt tension applied, nips as primary-transfer portions N1*a*, N1*b*, N1*c* and N1*d* are formed between the intermediary transfer belt 7 and the respective photosensitive drums 1*a*-1*d*. The inner secondary-transfer roller 10 is driven by a motor with excellent constant speed property, and functions as a driving roller for circulating and driving the intermediary transfer belt 7.

The recording material is accommodated in a sheet tray for accommodating the recording material P. The recording material P is picked up by a pick-up roller at predetermined timing from the sheet tray and is fed to a registration roller. In synchronism with the feeding of the toner image on the intermediary transfer belt, the recording material P is fed by the registration roller to the secondary-transfer portion N2 for transferring the toner image from the intermediary transfer belt onto the recording material.

The outer secondary-transfer roller 13 (transfer member) is disposed at a position opposing the inner secondary-transfer roller 10 via the intermediary transfer belt 7 from the outer peripheral surface of the intermediary transfer belt, and urges the inner secondary-transfer roller 10. The outer secondary-transfer roller 13 is a secondary-transfer member (transfer member) for forming the secondary-transfer portion N2 (secondary-transfer position) together with the inner secondary-transfer roller 10. A secondary-transfer high-voltage source 22 (power source) as a secondary-transfer voltage source is connected to the outer secondary-transfer roller 13, and is a voltage source (power source) capable of applying a voltage to the outer secondary-transfer roller 13.

When the recording material P is fed to the secondary-transfer portion N2, a secondary-transfer electric field is formed by applying, to the outer secondary-transfer roller 13, the secondary-transfer voltage of an opposite polarity to the toner, so that the toner image is transferred from the intermediary transfer belt 7 onto the recording material.

Incidentally, the inner secondary-transfer roller 10 is formed with EPDM rubber. The inner secondary-transfer roller is set at 20 mm in diameter, 0.5 mm in rubber thickness and 70° in hardness (Asker-C). The outer secondary-transfer roller 13 includes an elastic layer formed of NBR rubber, EPDM rubber or the like, and a core metal. The outer secondary-transfer roller 13 is formed to have a diameter of 24 mm.

With respect to a direction in which the intermediary transfer belt 7 moves, in a downstream side than the secondary-transfer portion N2, an intermediary transfer belt cleaning device 14 for removing a residual toner and paper powder which remain on the intermediary transfer belt 7 without being transferred onto the recording material at the secondary-transfer portion N2 is provided.

[Primary-Transfer Electric Field Formation in Primary-Transfer-High-Voltage-Less-System]

This embodiment employs a constitution in which the voltage source exclusively for the primary-transfer is omitted for cost reduction. Therefore, in this embodiment, in order to electrostatically primary-transfer the toner image from the photosensitive drum onto the intermediary transfer belt 7, the secondary-transfer voltage source 22 is used (hereinafter, this constitution is referred to as a primary-transfer-high-voltage-less-system).

However, in a constitution in which the roller for stretching the intermediary transfer belt is directly connected to the ground, even when the secondary-transfer voltage source 22 applies the voltage to the outer secondary-transfer roller 13, there is a liability that most of the current flows into the stretching roller side, and the current does not flow into the photosensitive drum side. That is, even when the secondary-transfer voltage source 22 applies the voltage, the current does not flow into the photosensitive drums 101*a*, 101*b*, 101*c* and 101*d* via the intermediary transfer belt 7, so that the primary-transfer electric field for transferring the toner image does not act between the photosensitive drums and the intermediary transfer belt.

Therefore, in order to cause a primary-transfer electric field action to act in the primary-transfer-high-voltage-less-system, it is desirable that passive elements are provided between each of the stretching rollers 10, 11 and 12 and the ground so as to pass the current toward the photosensitive drum side.

As a result, a potential of the intermediary transfer belt becomes high, so that the primary-transfer electric field acts between the photosensitive drum and the intermediary transfer belt.

Incidentally, in order to form the primary-transfer electric field in the primary-transfer-high-voltage-less-system, there is a need to pass the current along the circumferential direction of the intermediary transfer belt by applying the voltage from the secondary-transfer voltage source 22 (power source). However, if a resistance of the intermediary transfer belt itself is high, a voltage drop of the intermediary transfer belt with respect to a movement direction (circumferential direction) in which the intermediary transfer belt moves becomes large. As a result, there is also a liability that the current is less liable to pass through the intermediary transfer belt along the circumferential direction toward the photosensitive drums 1*a*, 1*b*, 1*c* and 1*d*. For that reason, the intermediary transfer belt may desirably have a low-resistant layer. In this embodiment, in order to suppress the voltage drop in the intermediary transfer belt, the base layer of the intermediary transfer belt is formed so as to have a surface resistivity of $10^2$ Ω/square or more and $10^8$ Ω/square or less. Further, in this embodiment, the intermediary transfer belt has the two-layer structure. This is because by disposing the high-resistant layer as the surface layer, the current flowing into a non-image portion is suppressed, and thus a transfer property is further enhanced easily. Of course, the layer structure is not intended to be limited to this structure. It is also possible to employ a single-layer structure or a structure of three layers or more.

Next, by using FIG. 2, a primary-transfer contrast which is a difference between the potential of the photosensitive drum and the potential of the intermediary transfer belt will be described.

Figure 2:
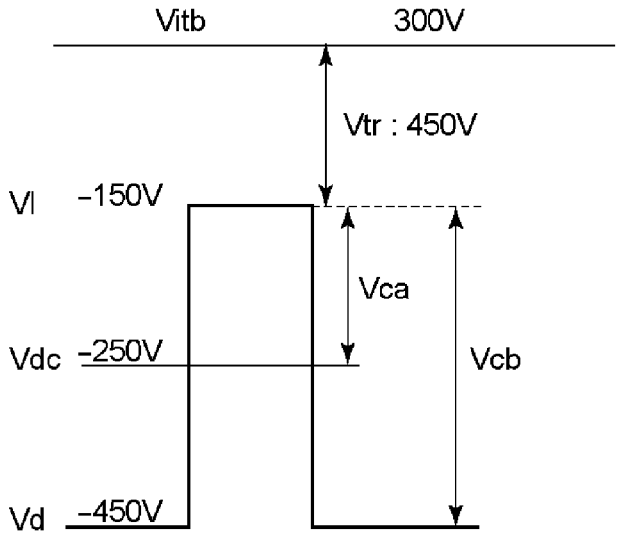
FIG. 2 is an illustration showing a relationship between a transferring potential and an electrostatic image potential.

FIG. 2 is the case where the surface of the photosensitive drum 1 is charged by the charging means 2, and the photosensitive drum surface has a potential Vd (−450 V in this embodiment). Further, FIG. 2 is the case where the surface of the charged photosensitive drum is exposed to light by the exposure means 3, and the photosensitive drum surface has V1 (−150 V in this embodiment). The potential Vd is the potential of the non-image portion where the toner is not deposited, and the potential V1 is the potential of an image portion where the toner is deposited. Vitb shows the potential of the intermediary transfer belt.

The surface potential of the drum is controlled on the basis of a detection result of a potential sensor provided in proximity to the photosensitive drum in a downstream side of the charging and exposure means and in upstream of the developing means.

The potential sensor detects the non-image portion potential and the image portion potential of the photosensitive drum surface, and controls a charging potential of the charging means on the basis of the non-image portion potential and controls an exposure light amount of the exposure means on the basis of the image portion potential.

By this control, with respect to the surface potential of the photosensitive drum, both potentials of the image portion potential and the non-image portion potential can be set at proper values.

With respect to this charging potential on the photosensitive drum, a developing bias Vdc (−250 V as a DC component in this embodiment) is applied by the developing device 4, so that a negatively charged toner is formed in the photosensitive drum side by development.

A developing contrast Vca which is a potential difference between the V1 of the photosensitive drum and the developing bias Vdc is: −150 (V)−(−250 (V))=100 (V).

An electrostatic image contrast Vcb which is a potential difference between the image portion potential V1 and the non-image portion potential Vd is: −150 (V)−(−450 (V))=300 (V).

A primary-transfer contrast Vtr which is a potential difference between the image portion potential V1 and the potential Vitb (300 V in this embodiment) of the intermediary transfer belt is: 300 V−(−150 (V))=450 (V).

Incidentally, in this embodiment, a constitution in which the potential sensor is disposed by attaching importance to accuracy of detection of the photosensitive drum potential is employed, but the present invention is not intended to be limited to this constitution. It is also possible to employ a constitution in which a relationship between the electrostatic image forming condition and the potential of the photosensitive drum is stored in ROM in advance by attaching importance to the cost reduction without disposing the potential sensor, and then the potential of the photosensitive drum is controlled on the basis of the relationship stored in the ROM.

[Zener Diode]

In the primary-transfer-high-voltage-less-system, the primary-transfer is determined by the primary-transfer contrast (primary-transfer electric field) which is the potential difference between the potential of the intermediary transfer belt and the potential of the photosensitive drum. For that reason, in order to stably form the primary-transfer contrast, it is desirable that the potential of the intermediary transfer belt is kept constant.

Therefore, in this embodiment, Zener diode is used as a constant-voltage element disposed between the stretching roller and the ground. Incidentally, in place of the Zener diode, a varister may also be used.

Figure 3:
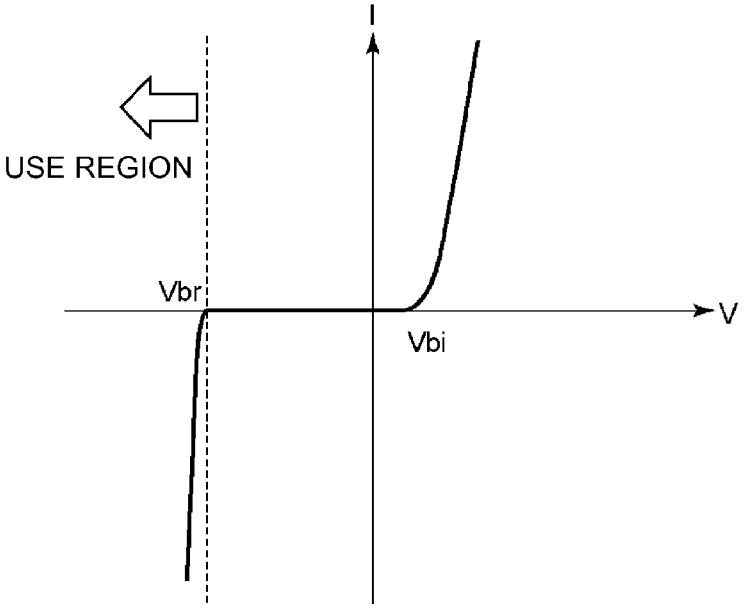
FIG. 3 is an illustration showing an IV characteristic of a Zener diode.

FIG. 3 shows a current-voltage characteristic of the Zener diode. The Zener diode causes the current to little flow until a voltage of Zener breakdown voltage Vbr or more is applied, but has a characteristic such that the current abruptly flows when the voltage of the Zener breakdown voltage or more is applied. That is, in a range in which the voltage applied to the Zener diode 15 is the Zener breakdown voltage (breakdown voltage) or more, the voltage drop of the Zener diode 15 is such that the current is caused to flow so as to maintain a Zener voltage.

By utilizing such a current-voltage characteristic of the Zener diode, the potential of the intermediary transfer belt 7 is kept constant.

That is, in this embodiment, the Zener diode 15 is disposed as the constant-voltage element between each of the stretching rollers 10, 11 and 12 and the ground.

In addition, during the primary-transfer, the secondary-transfer voltage source 22 applies the voltage so that the voltage applied to the Zener diode 15 is kept at the Zener breakdown voltage. As a result, during the primary-transfer, the belt potential of the intermediary transfer belt 7 can be kept constant.

In this embodiment, between each of the stretching rollers and the ground, 12 pieces of the Zener diode 15 providing a standard value Vbr, of 25 V, of the Zener breakdown voltage are disposed in a state in which they are connected in series. That is, in the range in which the voltage applied to the Zener diode is kept at the Zener breakdown voltage, the potential of the intermediary transfer belt is kept constant at the sum of Zener breakdown voltages of the respective Zener diodes, i.e., 25×12=300 V.

Of course, the present invention is not intended to be limited to the constitution in which the plurality of Zener diodes are used. It is also possible to employ a constitution using only one Zener diode.

Of course, the surface potential of the intermediary transfer belt is not intended to be limited to a constitution in which the surface potential is 300 V. The surface potential may desirably be appropriately set depending on the species of the toner and a characteristic of the photosensitive drum.

In this way, when the voltage is applied by the secondary-transfer voltage source 22, the potential of the Zener diode maintains a predetermined potential, so that the primary-transfer electric field is formed between the photosensitive drum and the intermediary transfer belt. Further, similarly as the conventional constitution, when the voltage is applied by the secondary-transfer high-voltage source, the secondary-transfer electric field is formed between the intermediary transfer belt and the outer secondary-transfer roller.

[Controller]

Figure 4:
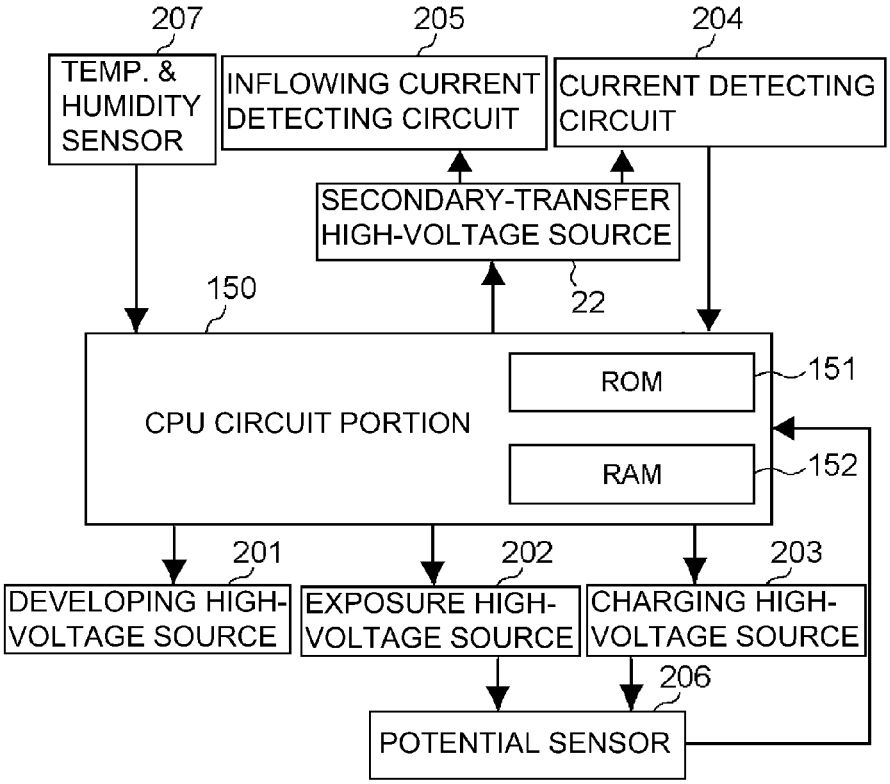
FIG. 4 is an illustration showing a block diagram of a control.

A constitution of a controller for effecting control of the entire image forming apparatus will be described with reference to FIG. 4. The controller includes a CPU circuit portion 150 (controller) as shown in FIG. 4. The CPU circuit portion 150 incorporates therein CPU, ROM 151 and RAM 152. A secondary-transfer portion current detecting circuit 204 is a circuit (detecting portion) for detecting a current passing through the outer secondary-transfer roller. A stretching-roller-inflowing-current detecting circuit 205 (current detecting portion) is a circuit for detecting a current flowing into the stretching roller. A potential sensor 206 is a sensor for detecting the potential of the photosensitive drum surface. A temperature and humidity sensor 207 is a sensor for detecting a temperature and a humidity.

Into the CPU circuit portion 150, information from the secondary-transfer portion current detecting circuit 204, the stretching-roller-inflowing-current detecting circuit 205, the potential sensor 206 and the temperature and humidity sensor 207 is inputted. Then, the CPU circuit portion 150 effects integral control of the secondary-transfer voltage source 22, a developing high-voltage source 201, an exposure means high-voltage source 202 and a charging means high-voltage source 203 depending on control programs stored in the ROM 151. An environment table and a paper thickness correspondence table which are described later are stored in the ROM 151, and are called up and reflected by the CPU. The RAM 152 temporarily hold control data, and is used as an operation area of arithmetic processing with the control.

[Lower-Limit Voltage Determining Mode]

In this embodiment, in order to make the surface potential of the intermediary transfer belt not less than the Zener voltage, a mode for determining a lower-limit voltage of the voltage applied by the secondary-transfer voltage source is executed. Description will be made using FIG. 5.

In this embodiment, in order to determine the lower-limit voltage, the stretching-roller-inflowing-current detecting circuit (current detecting portion) for detecting the current flowing into the ground via the Zener diode 15 is used. The stretching-roller-inflowing-current detecting circuit is connected between the Zener diode and the ground potential. That is, each of the stretching rollers are connected to the ground potential via the Zener diode and the stretching-roller-inflowing-current detecting circuit.

As shown in FIG. 3, the Zener diode has a characteristic such that the current little flows in a range in which the voltage drop of the Zener diode is less than the Zener breakdown voltage. For that reason, when the stretching-roller-inflowing-current detecting circuit does not detect the current, it is possible to discriminate that the voltage drop of the Zener diode is less than the Zener breakdown voltage. Further, when the stretching-roller-inflowing-current detecting circuit detects the current, the voltage drop of the Zener diode can maintain the Zener breakdown voltage.

First, charging voltages for all the stations for Y, M, C and Bk are applied, so that the surface potential of the photosensitive drum is controlled at the non-image portion potential Vd.

Figure 5:
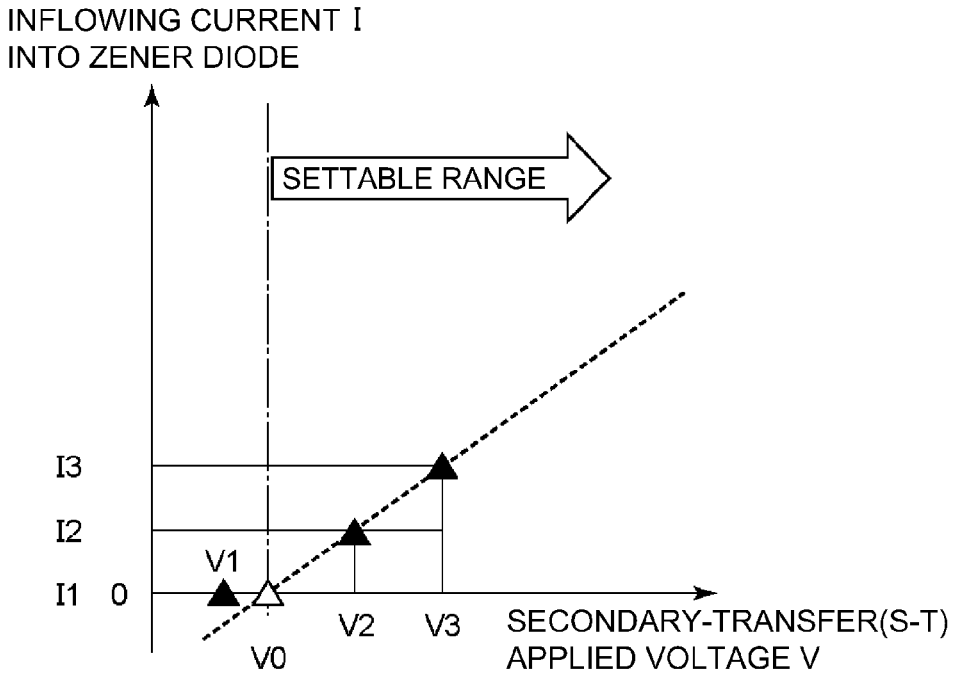
FIG. 5 is an illustration showing a relation between an inflowing current and an applied voltage.

Next, the secondary-transfer voltage source applies a test voltage. The test voltage applied by the secondary-transfer voltage source is increased linearly or stepwisely. In FIG. 5, the test voltage is increased stepwisely in the order of V1, V2 and V3. When the voltage applied by the secondary-transfer voltage source is V1, the current is not detected by the stretching-roller-inflowing-current detecting circuit (I1=0 μA). When the voltage applied by the secondary-transfer voltage source is V2 and V3, the stretching-roller-inflowing-current detecting circuit detects I2μA or I3μA, respectively. Here, from a correlation between an applied voltage and a detected current in the case where the stretching-roller-inflowing-current detecting circuit detects the current, a current inflowing starting voltage V0 corresponding to the case where the current starts to flow into the Zener diode is calculated. That is, from a relationship among I2, I3, V2 and V3, by performing linear interpolation, the current inflowing starting voltage V0 is carried.

As the voltage applied by the secondary-transfer voltage source, by setting a voltage exceeding V0, the voltage drop of the Zener diode can be made so as to maintain the Zener breakdown voltage.

Figure 6:
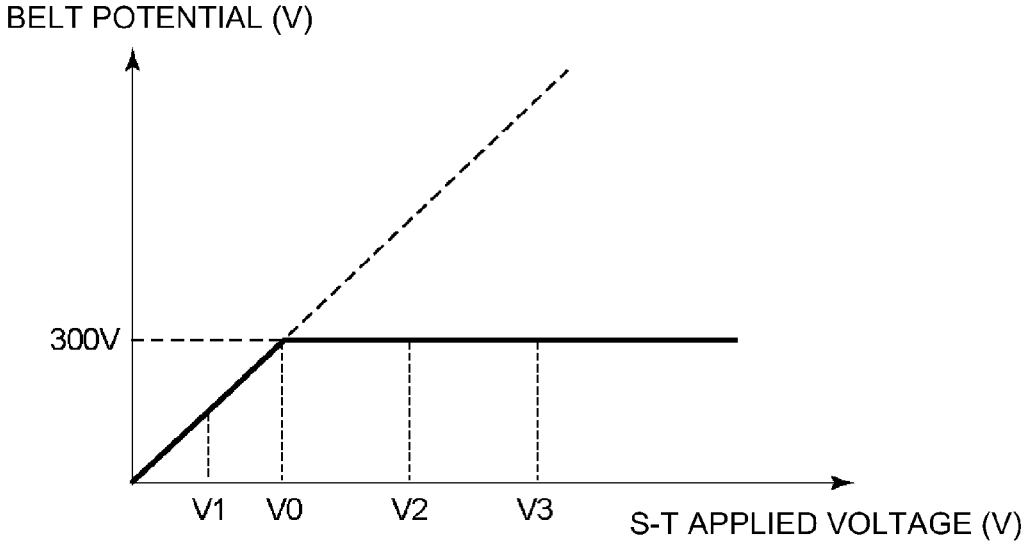
FIG. 6 is an illustration showing a relation between a belt potential and an applied voltage.

A relationship, at this time, between the voltage applied by the secondary-transfer voltage source and the belt potential of the intermediary transfer belt is shown in FIG. 6.

For example, in this embodiment, the Zener voltage of the Zener diode is set at 300 V. For that reason, in a range in which the potential of the intermediary transfer belt is less than 300 V, the current does not flow into the Zener diode, and when the belt potential of the intermediary transfer belt is 300 V, the current starts to flow into the Zener diode. Even when the voltage applied by the secondary-transfer voltage source is increased further, the belt potential of the intermediary transfer belt is controlled so as to be constant.

That is, in a range of less than V0 at which the flow of the current into the Zener diode is started to be detected, when the secondary-transfer bias is changed, the belt potential cannot be controlled at the constant voltage. In a range exceeding V0 at which the flow of the current into the Zener diode is started to be detected, even when the secondary-transfer bias is changed, the belt potential can be controlled at the constant voltage.

Incidentally, in this embodiment, before and after the current inflowing starting voltage are used as the test voltage, but the present invention is not intended to be limited to this constitution. As the test voltage, by setting a larger predetermined voltage in advance, it is also possible to employ a constitution in which all the test voltages exceeds the current inflowing starting voltage. In such a constitution, there is an advantage such that a discriminating step can be omitted.

Incidentally, in this embodiment, by attaching importance to enhancement of accuracy of calculation of the current inflowing starting voltage, a constitution in which a discriminating function for calculating the current inflowing starting voltage V0 is executed is employed. Of course, the present invention is not intended to be limited to this constitution. By attaching important to suppression of long downtime, not the constitution in which the discriminating function for calculating the current inflowing starting voltage V0 is executed, it is also possible to employ a constitution in which the current inflowing starting voltage V0 is stored in the ROM in advance.

[Test Mode for Setting Secondary-Transfer Voltage]

In this embodiment, in order to set the secondary-transfer voltage at which the toner image is to be transferred onto the recording material, a test mode which is called ATVC (Active Transfer Voltage Control) in which an adjusting voltage (test voltage) is applied is executed. This is an adjusting function for adjusting the voltage for the secondary-transfer and is executed during non-sheet-passing in which the recording material does not pass through the secondary-transfer portion. There is also a case where this test mode is executed when a region corresponding to a region between recording materials is in the secondary-transfer position in the case where the images are continuously formed. By the ATVC, it is possible to grasp a correlation between the voltage applied by the secondary-transfer voltage source and the current passing through the secondary-transfer portion.

In order to suppress the long downtime, it is desirable that the ATVC and the primary-transfer are carried out in parallel. However, when the ATVC and the primary-transfer are carried out in parallel, if the voltage drop of the Zener diode is less than the Zener breakdown voltage, there is a liability that the primary-transfer is made unstable.

Therefore, in this embodiment, when the ATVC and the primary-transfer are carried out in parallel when there is no recording material at the secondary-transfer portion, the adjusting voltage is set so that the voltage drop of the Zener diode is kept at the Zener breakdown voltage.

Incidentally, the ATVC is carried out by controlling the secondary-transfer voltage source by the CPU circuit portion 150 when there is no recording material at the secondary-transfer portion. That is, the CPU circuit portion 150 functions as an executing portion for executing the ATVC for setting the secondary-transfer voltage.

In the ATVC, a plurality of adjusting voltages Va, Vb and Vd which are constant-voltage-controlled are applied by the secondary-transfer voltage source. Then, in the ATVC, currents Ia, Ib and Ic flowing when the adjusting voltages are applied are detected, respectively, by the secondary-transfer portion current detecting circuit 204 (detecting portion). This is because the correlation between the voltage and the current is grasped.

Set values of the adjusting voltages in this embodiment will be described.

In this embodiment, the current inflowing starting voltage V0 is calculated by the discriminating function. ΔV1 and ΔV2 are stored in advance in the ROM of the CPU circuit portion. The adjusting voltage Va is calculated by adding ΔV1 to the current inflowing starting voltage V0, the adjusting voltage Vb is calculated by adding ΔV2 to the adjusting voltage Va, and the adjusting voltage Vc is calculated by adding ΔV2 to the adjusting voltage Vb. When the above is summarized, the respective adjusting voltages Va, Vb and Vc are represented by the following formulas.

$$Va = V0 + \Delta V1$$

$$Vb = Va + \Delta V2$$

$$Vc = Vb + \Delta V2$$

That is all the adjusting voltages Va, Vb and Vc including a lowest voltage Va of the adjusting voltages are set so as to exceed the current inflowing starting voltage V0. For that reason, during the execution of the ATVC, the voltage drop of the Zener diode is kept at the Zener breakdown voltage.

For that reason, in the case where the ATVC and the primary-transfer are carried out in parallel when no recording material exists at the secondary-transfer portion, it is suppressed that the voltage drop of the Zener diode is less than the Zener breakdown voltage.

Further, in this embodiment, ΔV1 is set so that the voltage Va which is smallest among the adjusting voltages is a lower value than the secondary-transfer voltage for forming the secondary-transfer electric field. Further, ΔV2 is set so that the voltage Vc which is largest among the adjusting voltages is higher value than the secondary-transfer voltage.

Incidentally, in this embodiment, also in the case where the ATVC is not carried out in parallel with the primary transfer, the setting of the adjusting voltage is the same as the case where the ATVC is carried out in parallel with the primary transfer. Incidentally, in this embodiment, when the ATVC is executed, a constitution in which the voltage drop of the Zener diode is always kept at the Zener breakdown voltage is employed. However, the present invention is not intended to be limited to this constitution. In a period in which the primary-transfer is not carried out when the ATVC is executed, it is also possible to employ a constitution in which the voltage drop of the Zener diode is not kept at the Zener breakdown voltage but is less than the Zener breakdown voltage.

[Secondary-Transfer Target Current Setting]

On the basis of a correlation between the plurality of applied adjusting voltages, Va, Vb and Vc and the measured currents Ia, Ib and Ic, a voltage Vi for causing a secondary-transfer target current It required for the secondary-transfer to flow is calculated. The secondary-transfer target current It is set on the basis of a matrix shown in Table 1.

TABLE 1

| | | | | | | | |
|---|---|---|---|---|---|---|---|
| WC*1 (g/kg) | 0.8 | 2 | 6 | 9 | 15 | 18 | 22 |
| STTC*2 (μA) | 32 | 31 | 30 | 30 | 29 | 28 | 25 |

*1"WC" represents water content.
*2"STTC" represents the secondary-transfer target current.

Table 1 is a table stored in a storing portion provided in the CPU circuit portion 150. This table sets and divides the secondary-transfer target current It depending on absolute water content (g/kg) in an atmosphere. This reason will be described. When the water content becomes high, a toner charge amount becomes small. Therefore, when the water content becomes high, the secondary-transfer target current It is set so as to become small. That is, when the water content is increased, the secondary-transfer target current is decreased. Incidentally, the absolute water content is calculated by the CPU circuit portion 150 from the temperature and relative humidity which are detected by the temperature and humidity sensor 207. Incidentally, in this embodiment, the absolute water content is used, but the water content is not intended to be limited to this. In place of the absolute water content, it is also possible to use the humidity.

Here, the voltage V1 for passing It is a voltage for passing It in the case where no recording material exists at the secondary-transfer portion. However, the secondary-transfer is carried out when the recording material exists at the secondary-transfer portion. Therefore, it is desirable that a resistance for the recording material is taken into account. Therefore, a recording material sharing voltage Vii is added to the voltage Vi. The recording material sharing voltage Vii is set on the basis of a matrix shown in Table 2.

TABLE 2

| | | | | | | | | |
|---|---|---|---|---|---|---|---|---|
| PLAIN PAPER 64-79 (gsm) (UNIT: V) | WC*1 | 0.8 | 2 | 6 | 9 | 15 | 18 | 22 |
| | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (gsm) (UNIT: V) | WC*1 | 0.8 | 2 | 6 | 9 | 15 | 18 | 22 |
| | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |
| 106-128 (gsm) (UNIT: V) | WC*1 | 0.8 | 2 | 6 | 9 | 15 | 18 | 22 |
| | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-150 (gsm) (UNIT: V) | WC*1 | 0.8 | 2 | 6 | 9 | 15 | 18 | 22 |
| | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represent the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage Vii depending on the absolute water content (g/kg) in an atmosphere and a recording material basis weight (g/m$^2$). When the basis weight is increased, the recording material sharing voltage Vii is increased. This is because when the basis weight is increased, the recording material becomes thick and therefore an electric resistance of the recording material is increased. Further, when the absolute water content is increased, the recording material sharing voltage Vii is decreased. This is because when the absolute water content is increased, the content of water contained in the recording material is increased, and therefore the electric resistance of the recording material is increased. Further, the recording material sharing voltage Vii is larger during automatic double-side printing and during manual double-side printing than during one-side printing. Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the CPU circuit portion 150 discriminate the basis weight.

A voltage (Vi+Vii) obtained by adding the recording material sharing voltage Vii to Vi for passing the secondary-transfer target current It is set, by the CPU circuit portion 150, as a secondary-transfer target voltage Vt, for secondary-transfer, which is constant-voltage-controlled. That is, the CPU circuit portion 150 functions as a controller for controlling the secondary-transfer voltage. As a result, a proper voltage value is set depending on an adjusting voltage environment and paper thickness. Further, during the secondary-transfer, the secondary-transfer voltage is applied in a constant-voltage-controlled state by the CPU circuit portion 150, and therefore even when a width of the recording material is changed, the secondary-transfer is carried out in a stable state.

[Timing of Control]

Figure 7:
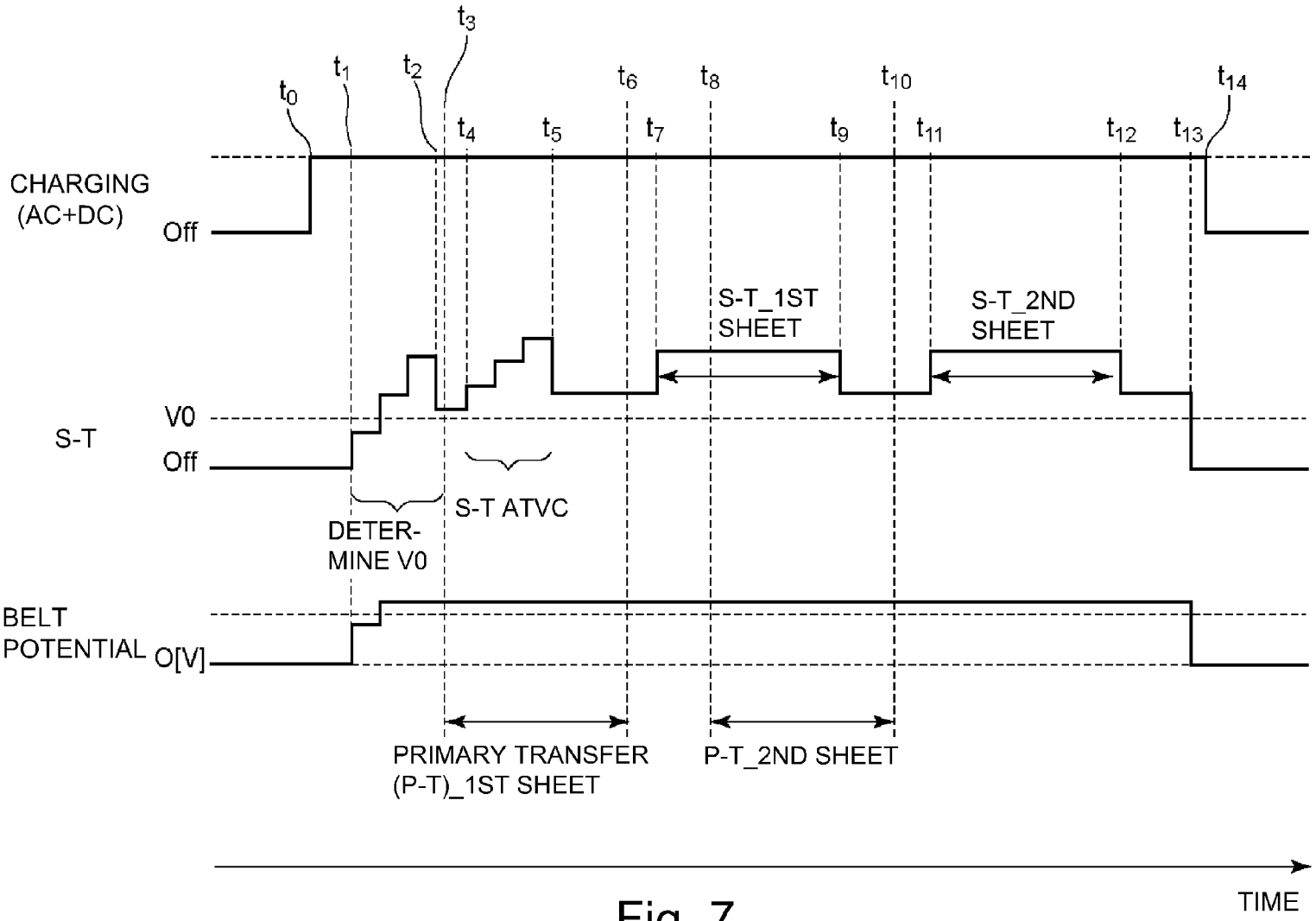
FIG. 7 is a time chart of a control of a secondary-transfer voltage source.

FIG. 7 shows a timing chart of a charging voltage (V, M, C, Bk), applied voltage of the secondary-transfer voltage source, primary-transfer and secondary-transfer. Incidentally, FIG. 7 is the case where the images are continuously formed on the recording materials.

When an image forming signal is inputted, the charging voltage is turned on (t0). Thereafter, the discriminating function for discriminating the current inflowing starting voltage V0 is executed in a period from t1 to t2. Thereafter, the ATVC is carried out in a period front t4 to t5. Thereafter, in a period from t7 to t9, the secondary-transfer is executed. The secondary-transfer is carried out by applying, when there is a first sheet of the recording material at the secondary-transfer portion, the secondary-transfer voltage set on the basis of the ATVC. Thereafter, in a period from t11 to t12, the secondary-transfer for a second sheet of the recording material passing through the secondary-transfer portion is executed. Thereafter, the voltage applied to the outer secondary-transfer roller is turned off (t13), and the charging is turned off (t14).

Further, in this embodiment, a voltage lowering function for lowering the voltage is executed in a period from discriminating function end timing (t2) to ATVC start timing (t4). Further, the voltage lowering function for lowering the voltage is executed in a period from ATVC end timing (t5) to secondary-transfer start timing (t7) for the first sheet of the recording material. Further, the voltage lowering function for lowering the voltage is executed in a period from secondary-transfer end timing (t9) to secondary-transfer start timing (t11) for the second sheet of the recording material. The voltage lowering function is a function of applying a voltage lower than the transfer voltage for forming the secondary-transfer electric field. This reason will be described. For the secondary-transfer roller, an ion conductive material is used, and therefore there is a tendency that the electric resistance by energization is increased. That is because when the voltage applied to the outer secondary-transfer roller is large, the resistance of the outer secondary-transfer roller is increased early, and there is a liability that a lifetime ends early. Incidentally, in this embodiment, the primary-transfer for the first sheet of the recording material starts at timing (t3) after t2 and before t4, and ends at timing (t6) after t5 and before t7.

For that reason, in the period from t4 and t5, in a state in which no recording material exists at the secondary-transfer portion, the primary-transfer for the first sheet of the recording material and the ATVC are executed in parallel. When the adjusting voltage is applied, if the voltage drop of the Zener diode is less than the Zener breakdown voltage, there is a liability that the primary-transfer defect is caused. Therefore, in this embodiment, in order to compatibly realize the primary-transfer and the ATVC, all the adjusting voltages Va, Vb and Vc in the ATVC are set so that the voltage drop of the Zener diode maintains the Zener breakdown voltage. That is, $Va=V0+\Delta V1>V0$, $Vb=Va+\Delta V2>V0$ and $Vc=Vb+\Delta V2>V0$. As a result, even when the primary-transfer and the ATVC are executed in parallel, it is suppressed that the voltage drop of the Zener diode is less than the Zener breakdown voltage, and therefore it is possible to suppress generation of the primary-transfer defect.

Further, in the period from t5 to 6, in a state in which no recording material exists at the secondary-transfer portion, the primary-transfer for the first sheet of the recording material and the voltage lowering function is executed in parallel. When the voltage lowering function is executed, if the voltage drop of the Zener diode is less than the Zener breakdown voltage, there is a liability that the primary-transfer defect is caused. Therefore, in this embodiment, in order to compatibly realize the primary-transfer and the voltage application control, in the period from the t5 to t7, an applied voltage V4 in the voltage lowering function is set so that the voltage drop of the Zener diode maintains the Zener breakdown voltage. As V4, a value obtained by adding $\Delta V0$ to the current inflowing starting voltage V0 is set ($V4=V0+\Delta V0>V0$). Incidentally, V0 is calculated by the discriminating function, and $\Delta V0$ is stored in the RAM in advance. As a result, even when the primary-transfer and the voltage lowering function are executed in parallel, it is suppressed that the voltage drop of the Zener diode is less than the Zener breakdown voltage, and therefore it is possible to suppress generation of the primary-transfer defect.

In this embodiment, the primary-transfer of the second sheet starts at timing (t8) after t7 and before t9 and ends at timing (t10) after t9 and before t11.

For that reason, in a period from t8 to t9, the primary-transfer for the second sheet of the recording material and the secondary-transfer for the first sheet of the recording material are executed in parallel. The secondary-transfer voltage is set so that the voltage drop of the Zener diode maintains the Zener breakdown voltage. For that reason, even when the primary-transfer and the secondary-transfer are executed in parallel, it is possible to suppress generation of the primary-transfer defect resulting from a phenomenon that the voltage drop of the Zener diode is less than the Zener breakdown voltage.

In a period from t9 and t10, in a region between the first sheet of the recording material and the second sheet of the recording material, the primary-transfer and the voltage lowering function are executed in parallel. When the voltage lowering function is executed, if the voltage drop of the Zener diode is less than the Zener breakdown voltage, there is a liability that the primary-transfer defect is caused. Therefore, in this embodiment, in order to compatibly realize the primary-transfer and the voltage application control, in the period from the t9 to t11, the applied voltage V4 ($Vd=V0+\Delta V0>V0$) in the voltage lowering function is set so that the voltage drop of the Zener diode maintains the Zener breakdown voltage. As a result, even when the primary-transfer and the voltage lowering function are executed in parallel in the region between the recording materials, it is possible to suppress generation of the primary-transfer defect due to a phenomenon that the voltage drop of the Zener diode is less than the Zener breakdown voltage.

Incidentally, in this embodiment, in a period from timing when the primary-transfer onto the first recording material to the end of the secondary-transfer onto the final recording material, the voltage is set so as to always maintain the Zener breakdown voltage. However, the present invention is not intended to be limited to this constitution. For example, in this embodiment, even in the period from t6 to t7, a constitution in which the voltage applied to the outer secondary-transfer roller by the secondary-transfer voltage source 22 is set so that the voltage drop of the Zener diode maintains the Zener breakdown voltage is employed. However, in the period from t6 to t7, the primary-transfer is not carried out. Therefore, by attaching importance to suppression of the energization deterioration of the secondary-transfer roller, in the period from t6 to t7, it is also possible to employ a constitution in which the voltage is turned off. Also with respect to the period from t10 to t11, the above constitutions are similarly employed. That is, in this embodiment, also in the period from t10 to t11, the constitution in which the voltage applied to the outer secondary-transfer roller by the secondary-transfer voltage source 22 is set so that the voltage drop of the Zener diode maintains the Zener breakdown voltage is employed. However, in the period from t10 to t11, the primary-transfer is not carried out. Therefore, by attaching importance to suppression of the energization deterioration of the secondary-transfer roller, in the period from t10 to t11, it is also possible to employ the constitution in which the voltage is turned off.

On the other hand, in the case where the period from t10 to t11 is short compared with the time required for switching the above-described voltage (power) source voltage, the control means does not switch the voltage to be applied to the transfer member by the voltage source, the voltage applied to the outer secondary-transfer roller by the secondary-transfer voltage source 22 in the period from t9 to t10 is continuously applied also in the period from t10 to t11.

That is, in this embodiment, even when the ATVC or the voltage lowering function is executed in parallel with the primary-transfer when no recording material exists at the secondary-transfer portion, a minimum voltage at which the voltage drop of the Zener diode is not less than the Zener breakdown voltage is applied. For that reason, it is possible to suppress the energization deterioration of the secondary transfer roller.

Incidentally, in this embodiment, the image forming apparatus for forming the electrostatic image by the electrophotographic type is described, but this embodiment is not intended to be limited to this constitution. It is also possible to use an image forming apparatus for forming the electrostatic image by an electrostatic force type, not the electrophotographic type.

INDUSTRIAL APPLICABILITY

In the constitution in which the predetermined voltage is generated in the intermediary transfer member by the constant-voltage element, it becomes possible to set the necessary minimum voltage source voltage, so that it is possible to avoid the energization deterioration of the transfer member.

The invention claimed is:

1. An image forming apparatus comprising:

an image bearing member for bearing a toner image;

an intermediary transfer member for carrying the toner image transferred from the image bearing member at a primary-transfer position;

a transfer member, provided contactable to an outer peripheral surface of the intermediary transfer member, for transferring the toner image from the intermediary transfer member onto a recording material at a secondary-transfer position;

a constant-voltage element, electrically connected between the intermediary transfer member and a ground potential, for maintaining a predetermined voltage by passing of a current therethrough;

a power source for forming, by applying a voltage to the transfer member to pass the current through the constant-voltage element, both of a secondary-transfer electric field at the secondary-transfer position and a primary-transfer electric field at the primary-transfer position;

a current detecting portion for detecting the current passing through the constant-voltage element; and a control for controlling, on the basis of a result detected by said current detecting portion by applying a test voltage to said transfer member by said power source, a voltage to be applied to said transfer member by said power source so that said constant-voltage element maintains the predetermined voltage in a predetermined period.

2. An image forming apparatus according to claim 1, wherein the constant-voltage element is a Zener diode or a varistor.

3. An image forming apparatus according to claim 2, wherein the predetermined voltage is a breakdown voltage of the Zener diode.

4. An image forming apparatus according to claim 3, wherein the test voltage includes a plurality of different voltages at which the Zener diode provides a breakdown voltage, and said controller controls the power source so that the voltage applied to said transfer member by said power source when the current starts flowing into said current detecting portion is used as a voltage at which said constant-voltage element maintains the predetermined voltage.

5. An image forming apparatus according to claim 1, wherein the predetermined period is at least one period of a period in which the toner image is transferred onto said intermediary transfer member at the primary-transfer position and a period in which the toner image is transferred onto the recording material at the secondary-transfer position.

6. An image forming apparatus according to claim 5, wherein the voltage applied to said transfer member by said power source in the period in which the toner image is transferred onto the recording material at the secondary-transfer position is higher than the voltage applied to said transfer member by said power source in the period in which a region, of said intermediary transfer member, corresponding to a region between the recording material and a recording material in the case where images are continuously formed is in the secondary-transfer position.

7. An image forming apparatus according to claim 1, wherein the predetermined period is a period in which the voltage is applied to said transfer member by said power source, when no recording material exists at the secondary-transfer position, in order to set the secondary-transfer voltage.

8. An image forming apparatus according to claim 1, wherein the predetermined period is a period in which a region, of the intermediary transfer member, corresponding to a region between the recording material and a recording material in the case where images are continuously formed is in the secondary-transfer position.

9. An image forming apparatus according to claim 8, wherein in the case where a period in which the region, of said intermediary transfer member, corresponding to the region between the recording material and the recording material, in the case where the images are continuously formed, is in the secondary-transfer position and in which there is no toner image, at the primary-transfer position, to be transferred onto said intermediary transfer member is shorter than a time required to switch the voltage of said power source, said control does not switch the voltage to be applied from said power source to said transfer member.

10. An image forming apparatus according to claim 1, wherein the test voltage is applied to said transfer member by said power source at timing before the toner image is primary-transferred.

11. An image forming apparatus according to claim 1, wherein said current detecting portion is provided between said constant-voltage element and the ground potential.

12. An image forming apparatus according to claim 1, wherein the intermediary transfer member has a structure of two layers or more, and a volume resistivity of the layer in the outer peripheral surface side is higher than a volume resistivity of the layer in an inner peripheral surface side.

13. An image forming apparatus according to claim 1, wherein the intermediary transfer member is an intermediary transfer belt, and wherein the image forming apparatus comprises a plurality of stretching members for stretching the intermediary transfer belt in contact with an inner peripheral surface of the intermediary transfer belt.

* * * * *